US006561815B1

(12) United States Patent
Schmidt

(10) Patent No.: US 6,561,815 B1
(45) Date of Patent: May 13, 2003

(54) ELECTROMECHANICAL CONNECTING DEVICE

(76) Inventor: Siegfried Schmidt, Gudrunstr. 7, D-32312 Luebbecke (DE)

( * ) Notice: Subject to any disclaimer, the term of this patent is extended or adjusted under 35 U.S.C. 154(b) by 0 days.

(21) Appl. No.: 10/018,947

(22) PCT Filed: Jun. 30, 2000

(86) PCT No.: PCT/EP00/06131

§ 371 (c)(1),
(2), (4) Date: Mar. 18, 2002

(87) PCT Pub. No.: WO01/03249

PCT Pub. Date: Jan. 11, 2001

(30) Foreign Application Priority Data

Jul. 2, 1999 (DE) ..... 199 30 642

(51) Int. Cl.[7] ..... H01R 11/30
(52) U.S. Cl. ..... 439/38
(58) Field of Search ..... 439/38, 39, 40, 439/188, 289; 336/DIG. 2, 107; 200/51.1

(56) References Cited

U.S. PATENT DOCUMENTS 5,401,175 A * 3/1995 Guimond et al. ..... 439/38
5,829,987 A * 11/1998 Fritsch et al. ..... 200/51.09
5,921,783 A * 7/1999 Fritsch et al. ..... 439/38
5,924,897 A * 7/1999 Abadia ..... 439/699.1
6,174,203 B1 * 1/2001 Asao ..... 439/38
6,231,349 B1 * 5/2001 Bullinger et al. ..... 439/1

OTHER PUBLICATIONS

US 6,264,473, 7/2001, Bullinger et al. (withdrawn)*

* cited by examiner

*Primary Examiner*—P. Austin Bradley
*Assistant Examiner*—Edwin A. León
(74) *Attorney, Agent, or Firm*—Holland & Knight LLP

(57) ABSTRACT

An electromechanical connector having a pair of detachably mateable contact mechanisms the housing of at least one of which includes an elastic wall to which is coupled at least one electrical contact which is either itself a magnetic member or which is coupled to a magnetic member. When the mechanisms are brought into mating proximity of one another, the magnetic member generates a force due to magnetic interaction with the other mechanism. The force causes the elastic wall to elastically yield, causing the contact to undergo an excursion into conducting relation with a corresponding contact of the other mechanism.

38 Claims, 3 Drawing Sheets

ELECTROMECHANICAL CONNECTING DEVICE

CROSS REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC.

Not applicable.

REFERENCE TO A MICROFICHE APPENDIX

Not applicable

FIELD OF THE INVENTION

The invention relates to the field of electromechanical connecting devices of the type having a pair of detachably mateable mechanisms at least one of which includes at least one electrical contact which is urged into electrically conducting relation with a corresponding contact of the mating mechanism under the influence of a magnetic force generated when the mechanisms are brought into mating proximity of one another. More particularly, the present invention relates to a connector in which the housing of at least one of the mechanisms includes an elastic wall to which at least one contact is coupled and which elastically yields under the magnetic force to cause the contact to undergo an excursion into conducting relation with a corresponding contact of the other mechanism.

BACKGROUND

A generic device is described in EP 0 573 471. Instead of an electrical connection via a socket as current supply or current connecting device and a plug as load connecting device, a switching device and a tripping device are used for the current connection and in both devices contact elements constructed as flat contacts with surface contact are provided. This measure distinctly simplifies the current connection from a current source to a load and also makes it safer. In the case of a connection with a relatively high number of volts and/or amperes such as, e.g. a 110-volt or 220-volt connection, the contact elements can only be supplied with current in the case of a connection to the tripping device by means of an operating slide in the switching device which provides very high security against malfunctions and electrical accidents.

In the case of an extra-low voltage connection, the large-surface contacts have advantages with respect to a simple circuit, simple cleaning and a reliable contact connection. In DE 296 10 996.7, a low-voltage or extra-low voltage connection is described by means of which devices are operated, e.g. with an extra-low voltage up to 24 V or which are to be provided with pulses and/or control voltages.

When two contact elements or possibly also three contract elements are used, proper large-surface contacts can be established. The situation becomes more difficult, however, when contacts are to be established over a number of contact elements because it is not ensured in this case that the contact elements working together in each case rest well and reliably against one another in a large-surface contact.

Although it has already been proposed in DE 296 10 996.7 to provide the contact elements with pretensioning springs, such a type of connection becomes relatively elaborate and also susceptible to interference in the case of multipole contact connections The present invention is therefore based on the object of improving an electromechanical connecting device of the type mentioned above, so that even multipole contact connections can be established in a simple manner and with a reliable contact connection.

SUMMARY OF THE INVENTION

According to the invention, an electromechanical connector includes a first mechanism and a second mechanism adapted to mate detachably to one another. Each mechanism includes one or more electrical contacts each of which corresponds to a contact of the other mechanism. A housing of at least one of the mechanisms is provided with an elastic wall to which at least one contact is mechanically coupled. The contact is either itself a magnetic member, or is mechanically coupled to a magnetic member. The magnetic member can comprise a magnet or, in the case where the mating mechanism includes a magnet, the magnetic member may suitably comprise a member of magnetic material which is not itself a magnet but is capable of being attracted by a magnet in the mating mechanism. When the mechanism and the mating mechanism are brought into mating proximity of one another, the magnetic member is influenced by the other mechanism to impart a force on the contact. The elastic wall yields elastically under that force to permit the contact to undergo an excursion toward a mating contact of the other mechanism thereby establishing a reliable electrical connection between the contact and the mating contact.

Due to the fact that at least the contacts of one of the two mechanisms, namely the current or data supply mechanism or the load connecting or data pickup mechanism, are arranged in an at least partially elastic wall, the contacts, due to the magnetic force, can align themselves in the direction of the other mechanism in each case when the two mechanisms are being connected to one another and can thus establish an optimum large-surface contact connection.

The electromechanical connecting device according to the invention can be used in the most varied ways and in the most varied technical fields. A preferred field of application is, for example, the extra-low voltage area for transmitting extra-low voltages with a very low number of volts (e.g. less than 24 V) for generating control voltages or switching pulses or performing data transmissions.

To simplify matters, only one current supply mechanism and one load connecting mechanism will be discussed in each case in the text which follows although, naturally, this also means mechanisms which are provided exclusively or also in conjunction with voltage or pulse onward routing for data transmission. Similarly, it is also, of course, possible to transmit audio signals in this manner.

To reinforce the contact connection, e.g. for creating a higher contact force, the contacts of the two mechanisms can also be supported in an elastic wall, e. g. a plastic diaphragm, if necessary.

The contacts can be arranged separately from the magnetic members in the respective housing or simultaneously also represent the magnetic members. In the latter case, a very compact connecting device is obtained.

In simple cases in which accurate positioning of the contacts or contacts location is not important, it is sufficient if one of the two magnetic members cooperating with one another during switching contact upon mating of the two mechanisms is in each case constructed as a magnet and the other one is constructed as a magnetic part that is, a part of a magnetic material that, while being attractable by a magnet, is not itself a magnet.

If accurate correlation between the various contacts is required, the magnetic members which are in each case to be correlated with one another of the current supply mechanism and of the load connecting mechanism will be constructed as magnets with, in each case, oppositely directed polarities. This creates a precise and accurately correlated switching connection.

Such connection can be improved further with respect to a reliable switching connection and the avoidance of faulty switching if it is provided, in a further development of the invention, that each magnet in itself has differently polarized magnet particles next to one another which correspondingly collaborate with a magnet of the other device with correspondingly oppositely polarized magnet particles. Such an embodiment is described in principle in DE 195 12 334 C1. One of the essential advantages of this embodiment consists in that no switching connection is created with an opposite magnet which is not correspondingly coded, especially if an operating or magnet slide is provided in the current supply device which is located in a rest position, i. e. in a non-current-forwarding position, due to a permanent magnet as is described, e.g. in EP 0 573 471.

If the contacts are molded into the elastic wall or are supported in it in a fluid-tight manner, very reliable connecting devices can be produced which are arranged in an interference-free manner also in liquid or aggressive media or which are located in a correspondingly aggressive environment such as e.g. enameling works. Naturally, this fluid-tight arrangement is required in both mechanisms. This means if only one elastic wall is provided in one of the two mechanisms, the corresponding wall of the other mechanism should also be constructed in such a manner that the contacts are constructed in a fluid-tight manner in the housing wall in which the contacts are located.

Advantageous further developments and embodiments of the invention are obtained from the remaining subclaims and from the exemplary embodiments described in principle in the text which follows, referring to the drawings, in which like elements are indicated with like reference numerals:

DETAILED DESCRIPTION OF THE INVENTION

Figure 1:
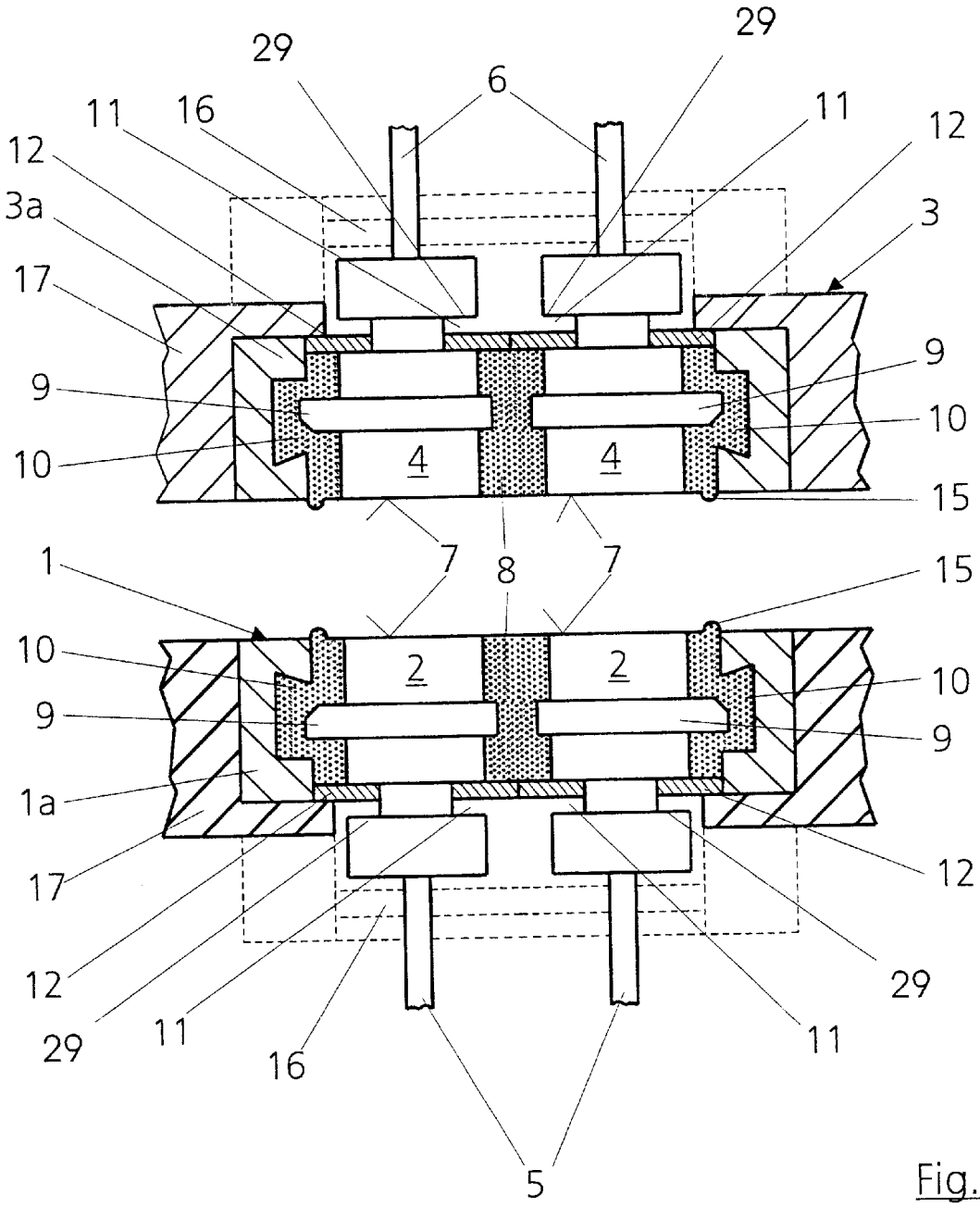
FIG. 1 shows an enlarged representation of a section according to line I—I of FIG. 2 through the electromechanical connecting device according to the invention.
Figure 2:
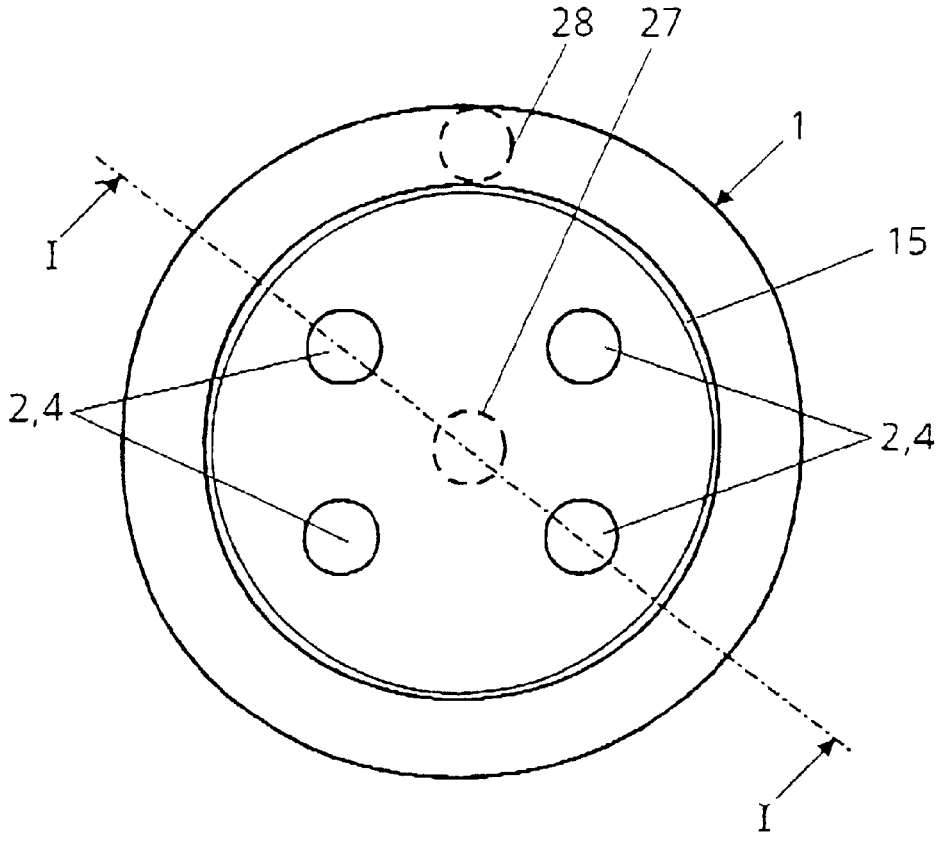
FIG. 2 shows a top view of a current or data supply device according to the invention.

FIGS. 1 and 2 show a current or data supply mechanism 1 with a housing 1*a* in which four contacts 2 constructed as large-surface contacts are arranged which cooperate with contacts 4, arranged in a housing 3*a* of a load connecting or data pickup mechanism 3 and are also constructed as flat contacts, for establishing a connecting device from a current source, not shown to a load, not shown. In the embodiment of FIGS. 1 and 2, the contacts 2 are constructed at the same time as the magnetic members which serve as switching magnets or magnetic switching parts and the contacts 4 are constructed at the same time as the magnetic members which serve as tripping magnets or magnetic tripping parts. That is, as shown in FIG. 1 the magnetic members are not distinct from contacts 2 and 4. Rather, each contact 2 and 4 is a unitary member which is not only electrically conductive but which also HAS magnetic properties. In particular, contacts 2 and 4 can be magnets which are oppositely polarized so as to forceably attract one another. Alternatively, contact 2 may be a magnet while its mutually opposed mating contact 4 may simply be formed of magnetic material which can be attracted by a magnet but is not itself a magnet. Conversely, a contact 4 may be a magnet while opposing contact 2 is simply of a magnetic material.

The contacts 2 of the current or data supply mechanism 1 are in each case individually connected via line connections 5 to a current, voltage or pulse source, not shown. This similarly applies to the contacts 4 of the load connecting or data pickup mechanism 3 from which in each case connecting lines 6 lead to a load, not shown. If necessary, the connecting lines 5 and 6 can also be omitted if the contacts 4 are arranged directly in or on the load or current, voltage or pulse pickup point. In principle, the load connecting or data pickup mechanism 3 can be of the same structure as the current or data supply mechanism 1 which is why like reference numerals are used for each except in the case of their respective (exception: contacts 2 and 4).

As can be seen from FIG. 1, the front end faces 7 of the contacts 2 are flat and at least approximately flush with the surface of the housing 1*a* which faces a load-connecting mechanism 3. The contacts 2 are molded into an elastic wall 8 of the housing, also flush with its surface. The elastic wall 8 can consist of various materials. In a simple manner, it is a flexible plastic, for example a diaphragm. The wall elastic 8 surrounds the contacts 2 in a fluid-tight manner at least in the area of the face ends or, respectively, the contacts 2 are embedded in it in a fluid-tight manner and are only exposed with their front end faces 7.

The contacts 2 inserted or molded into the elastic wall 8 can be completely flat, i. e. without convexity if they simultaneously act via magnetic forces. In the case of mechanically guided flat contacts, secure resting of the contact surfaces against one another is never guaranteed. As a rule, at least one of the two contact surfaces in flat contacts according to the prior art is for this reason constructed convexly which virtually mandatorily makes this a point contact.

A contact surface 7 acting with magnetic energy as is proposed according to the invention allows the contact 2 to rest on one another in a completely flat and precisely centered manner. The prerequisite for this is the elastic wall 8 according to the invention which allows corresponding movement with freedom of movement in the axial and radial direction. Naturally, as shown in FIG. 1, the elastic wall 8 must not completely surround the contacts 2 or 4. As shown in FIG. 1, each must have an exposed surface such as end face 7 for making contact with its mate. If necessary, it may also be sufficient for the elastic wall 8 to form a type of diaphragm in the surface area, the contacts 2 thus being also exposed in the rear area so that they can move even more easily because, in particular, the rear area of the contacts 2 and 4 should be able to move in all directions so that the large-surface contact occurs over the entire end faces 7 of the contacts 2.

Such a large-surface contact is of advantage, in particular, in the transmission of high power values, particularly high currents, to avoid inadmissible heating up due to the contact surface being too small.

In the case of sound transmission in a low hertz range but also in a high hertz range, a point contact would also mean a restriction in sound quality. At such frequencies, large currents flow, particularly in the case of sound transmissions with a high number of watts which need correspondingly safe contacts. The contacts 2 according to the invention meet these requirements and the contacts can be matched to the respective requirements without problems with respect to size and machining.

So that the contacts 2 are reliably held in the elastic wall 8, the contacts 2 can be provided with extensions, e.g. in each case a ring shoulder 9 in its peripheral wall. The same also applies to the elastic wall 8 which has one or more diameter extensions 10, e.g. also in ring form so that the entire unit is reliably supported in the housing 1*a*.

In addition, contacts 2 may be provided with an excursion limit. This can be formed, for example, by reductions or recesses 11 in the contacts. As shown in FIG. 1, recess 11 provides a surface 29 which cooperates with a stop member 12, for example in the form of a ring or a plate. The stop member 12 is permanently joined to the housing 1*a* and/or is held by the elastic wall 8.

The load connecting or data pickup mechanism 3 is basically constructed in the same manner as the current or data supply device 1. For this reason, the parts acting in the same manner are provided with the same reference numerals, apart from the contacts.

If the load connecting or data pickup mechanism 3 is then placed onto the current or data supply mechanism 1, the contacts 4 of the load connecting or data pickup mechanism 3 being aligned with the contacts 2 of the current or data supply mechanism 1, the contacts 2 "arch" outward or, respectively, toward the contacts 4 of the load connecting or data pickup mechanism 3 due to the elastic wall 8 and conversely also the contacts 4 in their elastic wall 8 and in this manner establish a good surface contact for all contacts for the entire area of their end faces 7.

The stop member 12 in each case acts, together with the rear wall, as excursion limit for the contacts 2 and 4, which are to be moved toward one another, due to the recess 11 in which the plate 12 is located with play. In this case, the surfaces 29 of contacts 2 and 4 in each case come to rest against the rear wall of the stop member 12. In general, an excursion of e.g. 0.1 to 0.5 mm ought to be sufficient for achieving a correspondingly reliable surface contact. This means a play between the stop member 12 and the surfaces 29 defined by recesses 11 in the contact elements 2 and 4 of this order of magnitude should be generally sufficient. The advantage of this embodiment lies in the fact that the elastic wall 8 diaphragms are not unnecessarily strained when the contacts 2 and 4 pull away or with excessive pressure from the front.

If necessary, the contacts 4 in the load connecting or data pickup mechanism 3 can also be located in a fixed wall in a simple embodiment unless an elastic wall 8 in the same embodiment as the wall 8 described in conjunction with FIG. 2 is also provided in order to obtain the best possible contact also in the case of a multiplicity of contact elements 2 and 4.

As can be seen, a connecting device having an arbitrary number of poles or contact elements with correct contact in each case can be created in this manner. Applications are, for example, robots, such as, e.g. in the motor vehicle industry, when spray heads are to be exchanged and, at the same time, data are also to be transmitted. In the aggressive environment of enameling works, in particular, the flat contact elements according to the invention are of particular advantage in comparison with the known plug connections which are difficult to clean and in some cases are also frequently damaged and thus become unusable.

Further fields of application are, e.g. trailer couplings of vehicles which generally have thirteen pins, and connections of computer components and their peripheral devices between one another such as, e.g. in an USB bus system.

Another field of application is, for example, ship or boat building with the problems entailed with respect to the aggressiveness of water, particularly of salt water.

If it is intended to prevent current from being permanently present at the contacts 2 of the current or data supply mechanism 1, it is only required to provide an operating slide between the contacts 2 and the line connections. Such an operating or magnetic slide and its operation is described in EP 0 573 471.

To establish a magnetic connection, it is sufficient if, for example, the contact elements 2 of the current or data supply device are constructed as magnets and the contact elements 4 of the load connecting or data pickup device 3 consist of a magnetic material such as, e. g. iron. Naturally, the reverse arrangement is also possible.

When magnets are used exclusively, they must be arranged in such a manner that contacts of the current or data supply mechanism 1 and of the load connecting or data pickup mechanism 3 are in each case opposite one another with different polarity. Similarly to the electromechanical connecting devices according to EP 0 573 471 or DE 195 12 334 C1, correspondingly "coded" magnets 2 and 4 can be provided as contact elements in order to maintain an accurate correlation between the various contact elements 2 and 4.

A very compact arrangement of the contact elements is shown in the embodiment which will now be described with additional reference to FIG. 3.

In distinction from FIGS. 1 and 2, where the contacts element 2 and 4 are in each case at the same time the switching magnets or tripping magnets or corresponding magnetic parts which are separate from the corresponding magnets in this embodiment. FIG. 3 shows the current or data supply mechanism 1' with three switching magnets 2'. Each switching magnet 2' is mechanically permanently connected to contacts 20, also in the form of flat contacts, via three ribs 14 which are uniformly distributed over the circumference and which should not be electrically conductive. All three switching magnets 2', together with their contacts 20 connected to them via the ribs 14 are embedded in the elastic wall 8'. If a load connecting or data pickup mechanism 3', constructed as a mirror image thereof, is placed on it, the case three contacts 20 of each magnet 2' also come into surface contact with the contact elements of the other device in each case due to the elasticity of the wall 8' because such a large-surface contact can be correctly established quite well with up to three parts to be brought into mutual contact.

Figure 3:
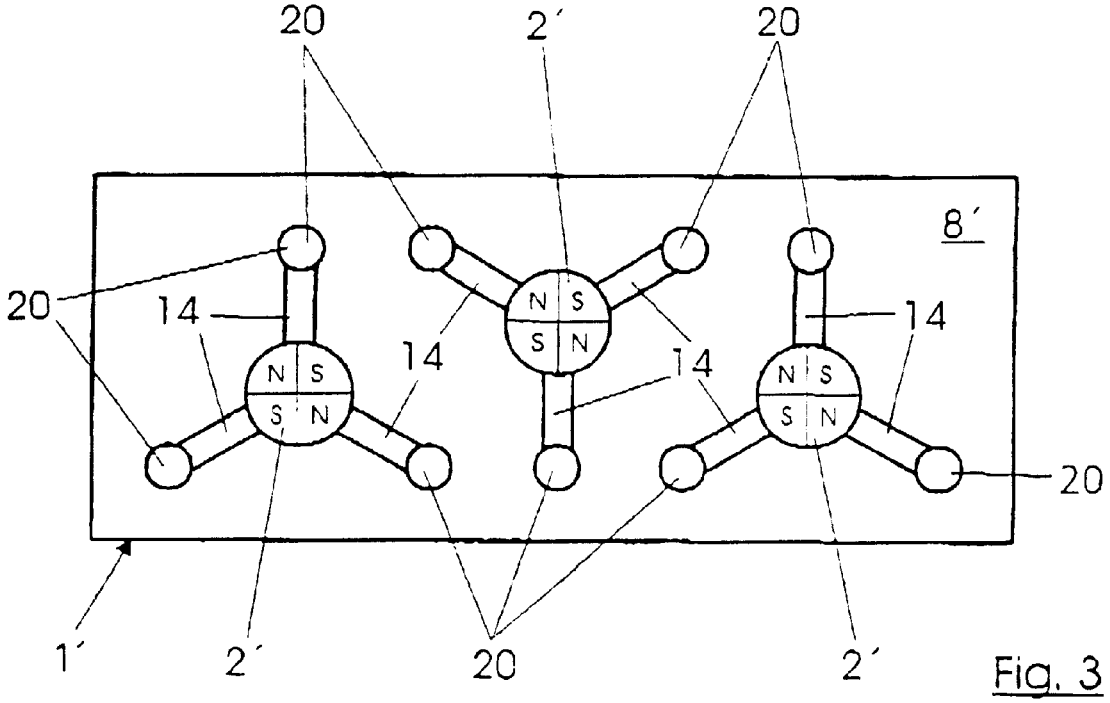
FIG. 3 shows a top view of a second embodiment of the invention with in each case three contacts connected mechanically to a magnet.

Naturally, the three tripping magnets 2' located next to one another are only shown by way of example in FIG. 3. Arbitrary numbers of contacts 20 can be accommodated in a very narrow space with corresponding enlargement or elongation of the housing. Naturally, the device can also be constructed in a circular manner in this case.

FIG. 1 also shows that the elastic wall 8 is provided with an outwardly directed convexity 15 on its outer circumference in the area of the end faces 7. This embodiment ensures a fluid-tight joint to an even greater extent. The same may also apply to the elastic wall 8 of the load connecting or data pickup mechanism 3.

If a multiplicity of contacts are to be provided in a very narrow space in order to achieve a connecting device with a very large number of poles, in which arrangement the contacts 2 or 4 become very small in their diameter, an amplifying magnet 16 can be provided behind or on the side facing away from the respective other mechanism to increase the magnetic force in one or in both mechanisms, i. e. the current or data supply mechanism 1 and/or the load connecting or data pickup mechanism 3 (see dashed representation in FIG. 1 together with a correspondingly enlarged housing 1*a* for the additional accommodation of the amplifying magnet 16, also shown dashed). In the case of a connection of the two mechanisms to one another, the amplifying magnet 16 in each case correspondingly increases the magnetic force and pushes the contacts 2 and 4 from the rear toward the front in the direction of the respective other mechanism. as a result of which the elastic wall 8 can bulge out or arch forward more easily and, as a result, an even more reliable large-surface contact connection is obtained.

The housing 1*a* of the current or data supply mechanism 1 can be installed in arbitrary devices, holders, wall parts or other devices 17. The same applies to the load connecting or data pickup mechanism 3.

Figure 4:
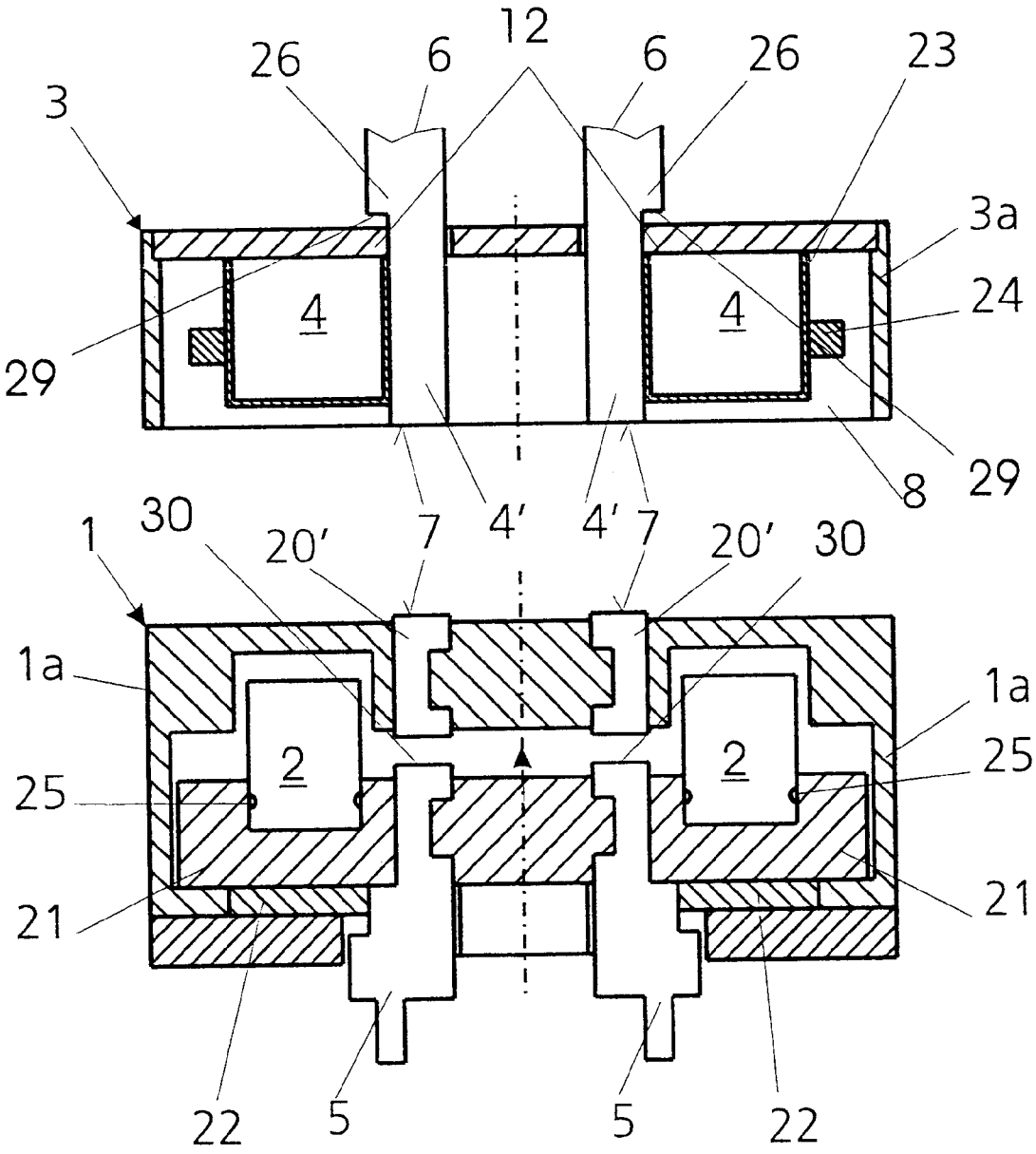
FIG. 4 shows a third exemplary embodiment which basically corresponds to the embodiment of FIG. 1 but additionally comprises an operating slide.

In FIG. 4, another exemplary embodiment is described which is basically constructed in the same manner as the exemplary embodiment of FIG. 1. For this reason, the same reference symbols have been retained for the same parts.

The current or data supply mechanism 1 is provided with an operating slide 21 in the interior of the housing 1*a*. As already mentioned, the operation of the operating slide 21 is already described in EP 0 573 471 which is why it will only be discussed briefly in the text which follows.

As can be seen, the magnets 2 and 4 and the contacts 20' and 4' are arranged separately of one another in this case and are newly provided with the reference symbol "20'" for the contacts in the current or data supply mechanism 1 and "4'" for the contacts in the load connecting or data pickup mechanism 3. The magnets 2 and the line connections 5 are connected to the operating slide 21 or arranged on it and each include a contact 30 as shown in FIG. 4. The operating slide 21 is kept in the rest position shown in FIG. 4 by a retaining member 22 which may comprise a magnet. The retaining member 22, which can be constructed to be ring-shaped, is arranged on the load connecting or data pickup device 3 of the operating slide 21 in the housing 1*a*. Naturally, instead of a magnet, retaining member 22, may suitably comprise a part which is ferromagnetic and which accordingly attracts the operating slide 21 with the magnet 2 arranged thereon.

As can be seen, this will not yet create a current connection for forwarding between the contacts 30 connected to line connections 5 and the contacts 20'. It is only when the load connecting or data pickup mechanism 3 is placed on the current or data supply mechanism 1 that the operating slide 21 lifts away from the rest position against the retaining force of the retaining member 22 due to the mutual forces of attraction of the magnets 2 and 4 and moves to in the direction of the arrow in FIG. 4 until reacting a second position at which contact is established between the contacts 30 connected to line connections 5 and the contacts 20' and thus a current connection to the contact elements 4' of the load connecting or data pickup mechanism 3. Naturally, for this purpose, the magnetic force between the retaining member 22 and the magnet 2 must be selected in such a manner that the forces of attraction by the magnets 4 are stronger, taking into consideration that the magnets 2 and 4 do not in each case project up to the surface but are slightly recessed or embedded (magnets 4 in the elastic wall 8 and magnets 2 under a cover). When the load connecting or data pickup mechanism 3 is removed, the operating slide 21 with the magnets 2 is attracted again by the retaining magnet 22 and the operating slide 21 thus returns into its rest position. In this manner, the contact elements 20' which, of course, are clearly accessible with the load connecting or data pickup mechanism 3 removed, are then free of current.

The device according to the invention can also be very advantageously used for, among other things, for transmitting current and transmitting signals for mobile telephones which, e. g. are to be arranged in a motor vehicle via a hands-free device. A multiplicity of contacts are required in this case. To transmit RF signals which, in general, must be provided with shielding and for which coaxial cables are generally used, the current or data supply mechanism 1 and the load connecting or data pickup mechanism 3 can be provided with corresponding connecting contacts for forwarding RF signals.

In FIG. 2, two installation points for such contacts are indicated, for example, by dashed circles "27" for a central coaxial arrangement and by "28" for an arrangement in a circumferential area for the current or data supply device 1. In accordance with the arrangement of contact 27 or 28, an opposite contact or opposite connecting piece (not shown) must be correspondingly provided in the load connecting or data pickup device 3.

If a number of contacts 4' must be accommodated for space reasons, it may also be necessary that the magnets 4 are electrically shielded by an insulating interlayer 23 so that no short circuits occur. To anchor the magnets 4 in the elastic wall 8, they can be provided with ring-shaped shoulders 24. This similarly applies to the magnets 2 on the operating slide 21. As an alternative solution, annular grooves 25 are provided for this purpose, into which the material of the operating slide protrudes.

Extensions 26 at the rear of the contact elements 4' or on the transition to the line connections 6 have a similar function as the recesses 11 according to FIG. 1, namely to achieve a stopping limit for the convexity of the elastic wall 8. As can be seen, there is a gap between a surface 29 of the extensions 26 and the rear wall of the housing 3*a*. Consequently, the elastic walls, due to the magnetic forces, can only arch forward by the amount of play between surface 29 and the stop member 12.

What is claimed is:

1. An electromechanical connector, comprising:

a first mechanism including at least one first electrical contact, and a second mechanism including at least one second electrical contact, said first mechanism and said second mechanism being detachably mateable to one another, said first mechanism further including a magnetic member and a housing, said housing including an elastic wall, said elastic wall being elastically yieldable in response to a force generated by said magnetic member under magnetic influence of said second mechanism when said first mechanism and said second mechanism are mated to one another, said magnetic member and said first contact both being located at least partially within said housing, said first contact being mechanically coupled to said magnetic member for movement with said magnetic member, at least one of said magnetic member and said first contact being mechanically coupled to said elastic wall, said elastic wall being elastically yieldable in response to said force generated by said magnetic member as to permit said first contact to undergo an excursion toward said second contact and to make physical and electrical contact with said second contact when said first mechanism and said second mechanism are mated to one another, whereby, upon mating of said first mechanism with said second mechanism, said excursion of said first contact due to yielding of said elastic wall in response to said force provides a reliable electrical connection between said first contact and said second contact.

2. The electromechanical connector of claim 1 wherein said magnetic member comprises a magnet.

3. The electromechanical connector of claim 1 wherein said magnetic member comprises a member of magnetic material which is not a magnet.

4. The electromechanical connector of claim 1 wherein said first contact includes a face which lies substantially flush with a surface of said elastic wall.

5. The electromechanical connector of claim 1 wherein said first contact and said magnetic member comprise a unitary member which is a magnet.

6. The electromechanical connector of claim 1 wherein said first contact and said magnetic member comprise a unitary member which is of a magnetic material which is capable of being attracted by a magnet but which is not a magnet.

7. The electromechanical connector of claim 1 wherein said first contact is partially embedded within said elastic wall in fluid-tight engagement with said elastic wall.

8. The electromechanical connector of claim 1 wherein said elastic wall comprises a plastic diaphragm.

9. The electromechanical connector of claim 1 wherein said first contact includes a face which engages said second contact when said first mechanism and said second mechanism are mated to one another, and said elastic wall includes a circumferential convexity which surrounds said face and projects outwardly from the remainder of said elastic wall to extend beyond said face, said convexity engaging said second mechanism when said first mechanism and said second mechanism are mated to one another, whereby said convexity forms a peripheral seal surrounding said face of said first contact.

10. The electromechanical connector of claim 1 wherein said first mechanism further comprises an amplifying magnet mounted in fixed relation to said housing and positioned as to increase said force.

11. The electromechanical connector of claim 1 wherein said first mechanism further comprises a connecting contact for forwarding RF signals and said second mechanism further comprises a mutually opposed RF contact.

12. The electromechanical connection of claim 1 wherein said second mechanism further comprises, a second housing, a slide mounted interiorly of said housing for movement between a first position and a second position, a third contact mechanically coupled to said slide for movement between said first position and said second position, said third contact being located to make physical and electrical contact with said second contact when said slide is in said second position and to be physically separated from said second contact and electrically isolated from said second contact when said slide is in said first position, a second magnetic member mechanically coupled to said slide for moving said slide between said first position and said second position, and a retaining member mounted to said housing in a location operable to exert a magnetic retaining force on said second magnetic member, said retaining force retaining said slide and said third contact in said first position when said first mechanism and said second mechanism are not mated to one another to maintain physical separation and electrical isolation between said second contact and said third contact when said first mechanism and said second mechanism are not mated to one another, said retaining force being sufficiently low as to be overcome by said force generated by said magnetic member of said first mechanism when said first mechanism and said second mechanism are mated together to permit said force imparted by said magnetic member of said first mechanism to overcome said retaining force and cause said magnetic member to move said slide into said second position to bring said third contact into physical and electrical contact with said second contact, whereby, said second contact is maintained electrically isolated from said third contact unless and until said first mechanism and said second mechanism are mated to one another to establish electrical continuity between said third contact and said first contact by way of said second contact.

13. The electromechanical connector of claim 12 wherein said second magnetic member comprises a magnet and said retaining member is a member comprised of magnetic material.

14. The electromechanical connector of claim 12 wherein said second magnetic member is a member comprised of magnetic material and said retaining member comprises a magnet.

15. The electromechanical connector of claim 12 wherein said retaining member is mounted in a location such that said slide lies interposed between said retaining member and said first mechanism when said first mechanism and said second mechanism are mated to one another.

16. The electromechanical connector of claim 1 wherein said first mechanism further comprises a stop member mounted in fixed relation to said housing, said first contact having a surface which engages said stop member to limit said excursion of said first contact.

17. The electromechanical connector of claim 16 wherein said excursion of said first contact is limited by said stop member to a distance of between 0.1 millimeters and 0.5 millimeters.

18. An electromechanical connector, comprising:

a first mechanism including a plurality of first electrical contacts, each one of said first contacts being electrically isolated from each other one of said first contacts, and a second mechanism including a plurality of second electrical contacts, each one of said second contacts being electrically isolated from each other one of said second contacts, said first mechanism and said second mechanism being detachably mateable to one another, said first mechanism further including at least one magnetic member and a housing, said housing including an elastic wall, said elastic wall being elastically yieldable in response to a force generated by said magnetic member under magnetic influence of said second mechanism when said first mechanism and said second mechanism are mated to one another, said magnetic member and each said first contacts all being located at least partially within said housing, each of said first contacts being mechanically coupled to said magnetic member for movement with said magnetic member, at least one of, said magnetic member and at least one of said first electrical contacts being mechanically coupled to said elastic wall, said elastic wall being elastically yieldable in response to said force generated by each said magnetic member as to permit each of said first electrical contacts to undergo an excursion toward said second contact and to make physical and electrical contact with a corresponding one of said second electrical contacts when said first mechanism and said second mechanism are mated to one another, whereby, upon mating of said first mechanism with said second mechanism, said excursion of said first electrical contacts due to yielding of said elastic wall in response to said force generated by each said magnetic member provides a reliable electrical connection between each one of said first electrical contacts and each said corresponding one of said second electrical contacts.

19. The electromechanical connector of claim 18 wherein at least one of said first electrical contacts is mechanically coupled to said magnetic member by way of a rib which is not electrically conductive.

20. The electromechanical connector of claim 18 wherein said magnetic member comprises a magnet.

21. The electromechanical connector of claim 18 wherein said magnetic member comprises a member of magnetic material which is not a magnet.

22. The electromechanical connector of claim 18 wherein said magnetic member comprises a magnet.

23. The electromechanical connector of claim 18 wherein said magnetic member and said first electrical contacts are embedded in said elastic wall.

24. An electromechanical connector, comprising:

a first mechanism including at least one first electrical contact, and a second mechanism including at least one second electrical contact, said first mechanism and said second mechanism being detachably mateable to one another, said first mechanism further including a housing having an elastic wall, said elastic wall being elastically yieldable in response to a force generated by said first contact under magnetic influence of said second mechanism when said first mechanism and said second mechanism are mated to one another, said first contact being located at least partially within said housing and being mechanically coupled to said elastic wall, said elastic wall being elastically yieldable in response to said force generated by said first contact as to permit said first contact to undergo an excursion toward said second contact and to make physical and electrical contact with said second contact when said first mechanism and said second mechanism are mated to one another, whereby, upon mating of said first mechanism with said second mechanism, said excursion of said first contact due to yielding of said elastic wall in response to said force provides a reliable electrical connection between said first contact and said second contact.

25. The electromechanical connector of claim 24 wherein said first contact comprises a magnet.

26. The electromechanical connector of claim 24 wherein said magnetic member comprises a member of magnetic material which is not a magnet.

27. The electromechanical connector of claim 24 wherein said first contact includes a face which lies substantially flush with a surface of said elastic wall.

28. The electromechanical connector of claim 24 wherein said first contact is partially embedded within said elastic wall in fluid-tight engagement with said elastic wall.

29. The electromechanical connector of claim 24 wherein said elastic wall comprises a plastic diaphragm.

30. The electromechanical connector of claim 24 wherein said first contact includes a face which engages said second contact when said first mechanism and said second mechanism are mated to one another, and said elastic wall includes a circumferential convexity which surrounds said face and projects outwardly from the remainder of said elastic wall to extend beyond said face, said convexity engaging said second mechanism when said first mechanism and said second mechanism are mated to one another, whereby said convexity forms a peripheral seal surrounding said face of said first contact.

31. The electromechanical connector of claim 24 wherein said first mechanism further comprises an amplifying magnet mounted in fixed relation to said housing and positioned as to increase said force.

32. The electromechanical connector of claim 24 wherein said first mechanism further comprises a connecting contact for forwarding RF signals and said second mechanism further comprises a mutually opposed RF contact.

33. The electromechanical connector of claim 24 wherein said first mechanism further comprises a stop member mounted in fixed relation to said housing, said first contact having a surface which engages said stop member to limit said excursion of said first contact.

34. The electromechanical connector of claim 33 wherein said excursion of said first contact is limited by said stop member to a distance of between 0.1 millimeters and 0.5 millimeters.

35. The electromechanical connection of claim 24 wherein said second mechanism further comprises, a second housing, a slide mounted interiorly of said housing for movement between a first position and a second position, a third contact mechanically coupled to said slide for movement between said first position and said second position, said third contact being located to make physical and electrical contact with said second contact when said slide is in said second position and to be physically separated from said second contact and electrically isolated from said second contact when said slide is in said first position, a magnetic member mechanically coupled to said slide for moving said slide between said first position and said second position, and a retaining member mounted to said housing in a location operable to exert a magnetic retaining force on said magnetic member, said retaining force retaining said slide and said third contact in said first position when said first mechanism and said second mechanism are not mated to one another to maintain physical separation and electrical isolation between said second contact and said third contact when said first mechanism and said second mechanism are not mated to one another, said retaining force being sufficiently low as to be overcome by said force generated by said first contact when said first mechanism and said second mechanism are mated together to permit said force generated by said first contact to overcome said retaining force and cause said first contact to move said slide into said second position to bring said third contact into physical and electrical contact with said second contact, whereby, said second contact is maintained electrically isolated from said third contact unless and until said first mechanism and said second mechanism are mated to one another to establish electrical continuity between said third contact and said first contact by way of said second contact.

36. The electromechanical connector of claim 35 wherein said magnetic member comprises a magnet and said retaining member is a member comprised of magnetic material.

37. The electromechanical connector of claim 35 wherein said magnetic member is a member comprised of magnetic material and said retaining member comprises a magnet.

38. The electromechanical connector of claim 35 wherein said retaining member is mounted in a location such that said slide lies interposed between said retaining member and said first mechanism when said first mechanism and said second mechanism are mated to one another.

* * * * *